US008387492B2

(12) United States Patent
Liu

(10) Patent No.: US 8,387,492 B2
(45) Date of Patent: Mar. 5, 2013

(54) HAND TOOL SET COMBINATION

(76) Inventor: Yi Feng Liu, Taipei (TW)

( * ) Notice: Subject to any disclaimer, the term of this patent is extended or adjusted under 35 U.S.C. 154(b) by 273 days.

(21) Appl. No.: 12/928,586

(22) Filed: Dec. 15, 2010

(65) Prior Publication Data

US 2012/0152068 A1 Jun. 21, 2012

(51) Int. Cl.
*B25B 23/16* (2006.01)
*B25F 1/04* (2006.01)
*B25G 1/08* (2006.01)

(52) U.S. Cl. ..... 81/440; 81/177.4; 7/138; 7/168

(58) Field of Classification Search ..... 81/440, 81/124.4, 177.4, 177.6; 7/100, 118, 138, 7/151, 165, 168
See application file for complete search history.

(56) References Cited

U.S. PATENT DOCUMENTS

| | | | | |
|---|---|---|---|---|
| 2,804,970 | A | 9/1957 | Kuc et al. | |
| 5,421,180 | A | 6/1995 | Rojdev | |
| 5,450,774 | A | 9/1995 | Chang | |
| 5,791,211 | A | 8/1998 | Bondhus et al. | |
| 6,062,111 | A * | 5/2000 | Wershe | 81/177.4 |
| 6,286,168 | B1 * | 9/2001 | Woodruff et al. | 7/138 |
| 6,298,756 | B1 | 10/2001 | Auderson et al. | |
| 6,564,678 | B1 * | 5/2003 | Wang | 81/124.4 |
| 6,868,760 | B1 * | 3/2005 | Johnson | 81/440 |

* cited by examiner

*Primary Examiner* — David B Thomas
(74) *Attorney, Agent, or Firm* — Charles E. Baxley

(57) ABSTRACT

A hand tool set includes two housings each having a chamber formed by a pair of side walls and a base wall, and each having an orifice formed in the base wall, and each having an anchoring member and a pivot axle, two or more tool members pivotally attached to one of the housings, and two or more tool elements pivotally attached to the other housing, and the tool elements are extendible out through an orifice of the other housing when the tool elements are perpendicular to the housing, and the tool members are extendible out through the orifice of the other housing when the tool members are perpendicular to the housing, the tool members and the tool elements are selectively useable by the users.

9 Claims, 6 Drawing Sheets

HAND TOOL SET COMBINATION

BACKGROUND OF THE INVENTION

1. Field of the Invention

The present invention relates to a hand tool set, and more particularly to a hand tool set combination including two casings engageble with each other and each casing having one or more pivotal or rotatable tool members for providing a variety of tool members of different sizes or dimensions or scales.

2. Description of the Prior Art

Typical hand tool sets comprise a housing having one or more pivotal or rotatable tool members attached or mounted or secured therein and foldable or rotatable out of the housing for engaging with and for driving or rotating various fasteners or other tool elements.

For example, U.S. Pat. No. 2,804,970 to Kuc et al., U.S. Pat. No. 5,421,180 to Rojdev, U.S. Pat. No. 5,450,774 to Chang, and U.S. Pat. No. 5,791,211 to Bondhus et al. disclose several of the typical hand tool sets each also comprising one or more pivotal or rotatable tool members attached or mounted or secured in a housing and foldable or rotatable out of the housing for engaging with and for driving or rotating various fasteners or other tool elements.

However, the housing may receive or engage with few tool members that may not provide the required number of tool members for working purposes, and the users may have to prepare two or more hand tool sets while working.

U.S. Pat. No. 6,298,756 to Anderson et al. discloses another typical hand tool set also comprising one or more pivotal or rotatable tool members attached or mounted or secured in a housing and foldable or rotatable out of the housing for engaging with and for driving or rotating various fasteners or other tool elements or for cutting or working with various work pieces.

However, similarly, the housing may receive or engage with few tool members that may not provide the required number of tool members for working purposes, and the users may have to prepare two or more hand tool sets while working.

The present invention has arisen to mitigate and/or obviate the afore-described disadvantages of the conventional hand tool sets or combinations.

SUMMARY OF THE INVENTION

The primary objective of the present invention is to provide a hand tool set combination including two casings engageble with each other and each casing having one or more pivotal or rotatable tool members for providing a variety of tool members of different sizes or dimensions or scales.

In accordance with one aspect of the invention, there is provided a hand tool set comprising a first housing including a chamber formed therein and defined by a pair of side walls and a base wall, and including an orifice formed in the base wall, and including a first anchoring member, a first pivot axle attached between the side walls of the first housing, at least two tool members pivotally engaged with the first pivot axle and rotatable relative to the first housing, a second housing including a chamber formed therein and defined by a pair of side walls and a base wall, and including an orifice formed in the base wall of the second housing, and including a second anchoring member for engaging with the first anchoring member and for anchoring the first and the second housings together, a second pivot axle attached between the side walls of the second housing, and at least two tool elements pivotally engaged with the second pivot axle and rotatable relative to the second housing, and the tool elements of the second housing being extendible out through the orifice of the first housing when the tool elements are perpendicular to the second housing, and the tool members of the first housing being extendible out through the orifice of the second housing when the tool members are perpendicular to the first housing.

The tool members each include a ring provided on one end thereof for pivotally engaging with the first pivot axle of the first housing. The tool members each include a tool device provided on a free end thereof.

The tool elements each include a ring provided on one end thereof for pivotally engaging with the second pivot axle of the second housing. The tool elements each include a tool device provided on a free end thereof.

The first housing includes an opening formed therein and communicative with the chamber thereof for selectively engaging with the tool members. The second housing includes an opening formed therein and communicative with the chamber thereof for selectively engaging with the tool elements.

The first and the second housings each include at least one magnetic member for engaging with each other and for anchoring the first and the second housings together. The first and the second housings each include a frame engaged into the chamber thereof and having a compartment formed therein and defined by a pair of side panels and a base panel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
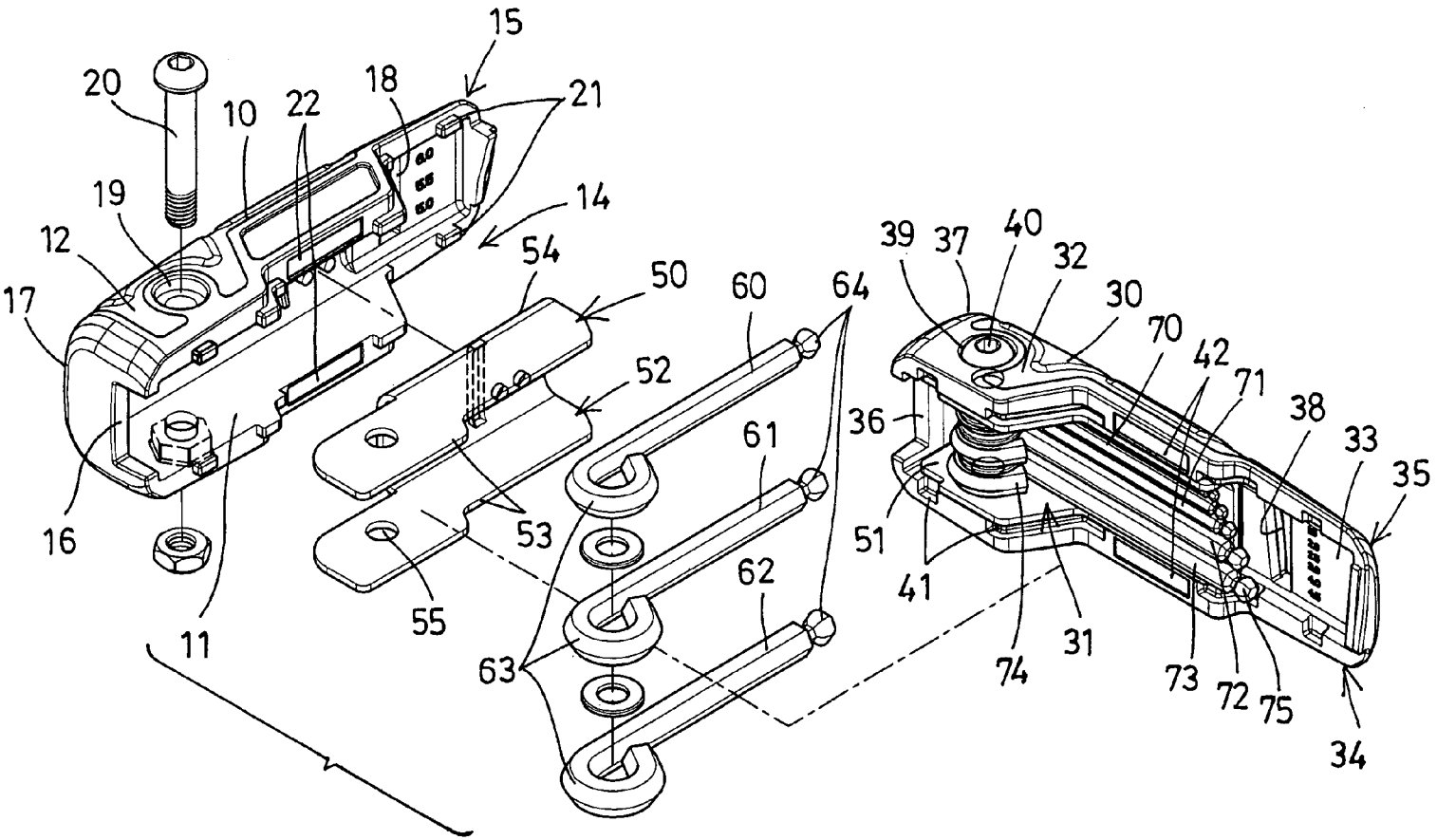
FIG. 1 is an exploded view of a hand tool set combination in accordance with the present invention.
Figure 2:
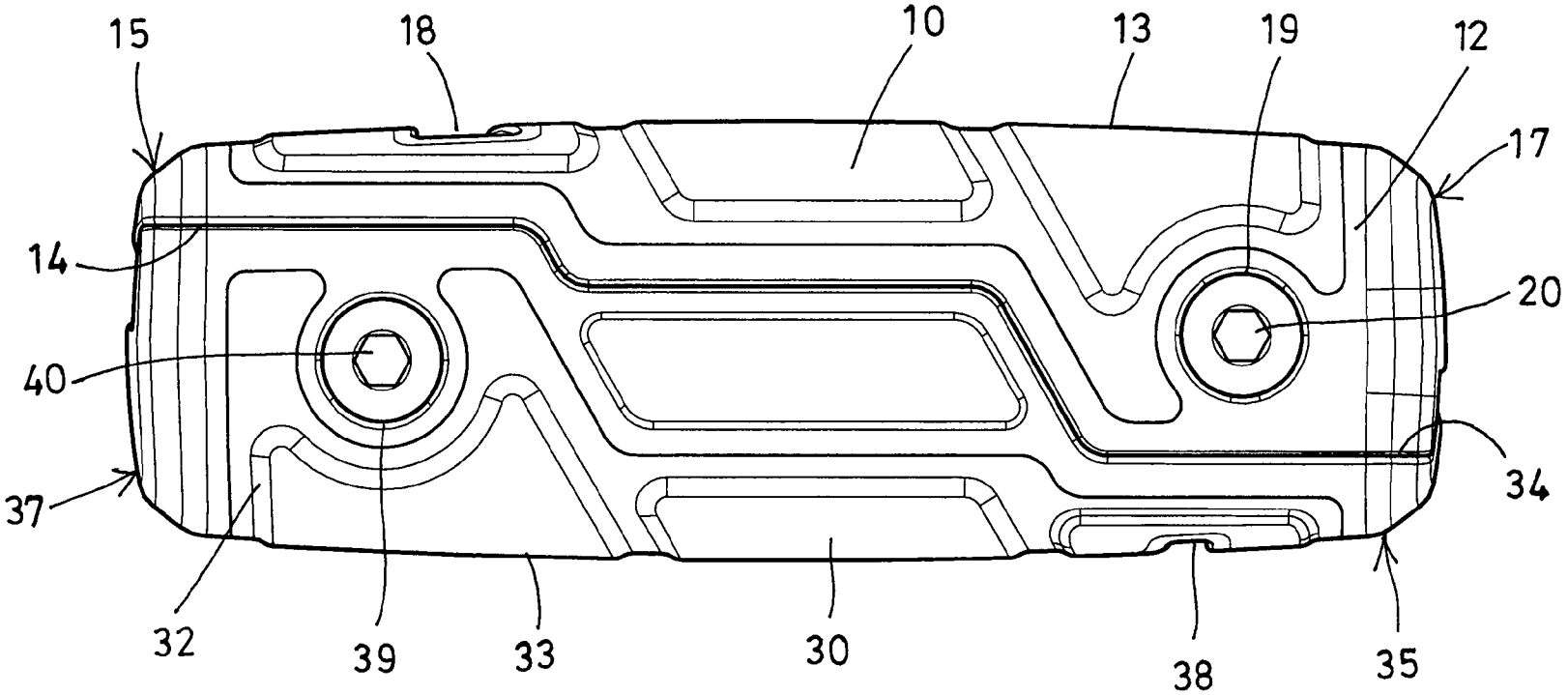
FIG. 2 is a plan schematic view of the hand tool set combination.
Figure 3:
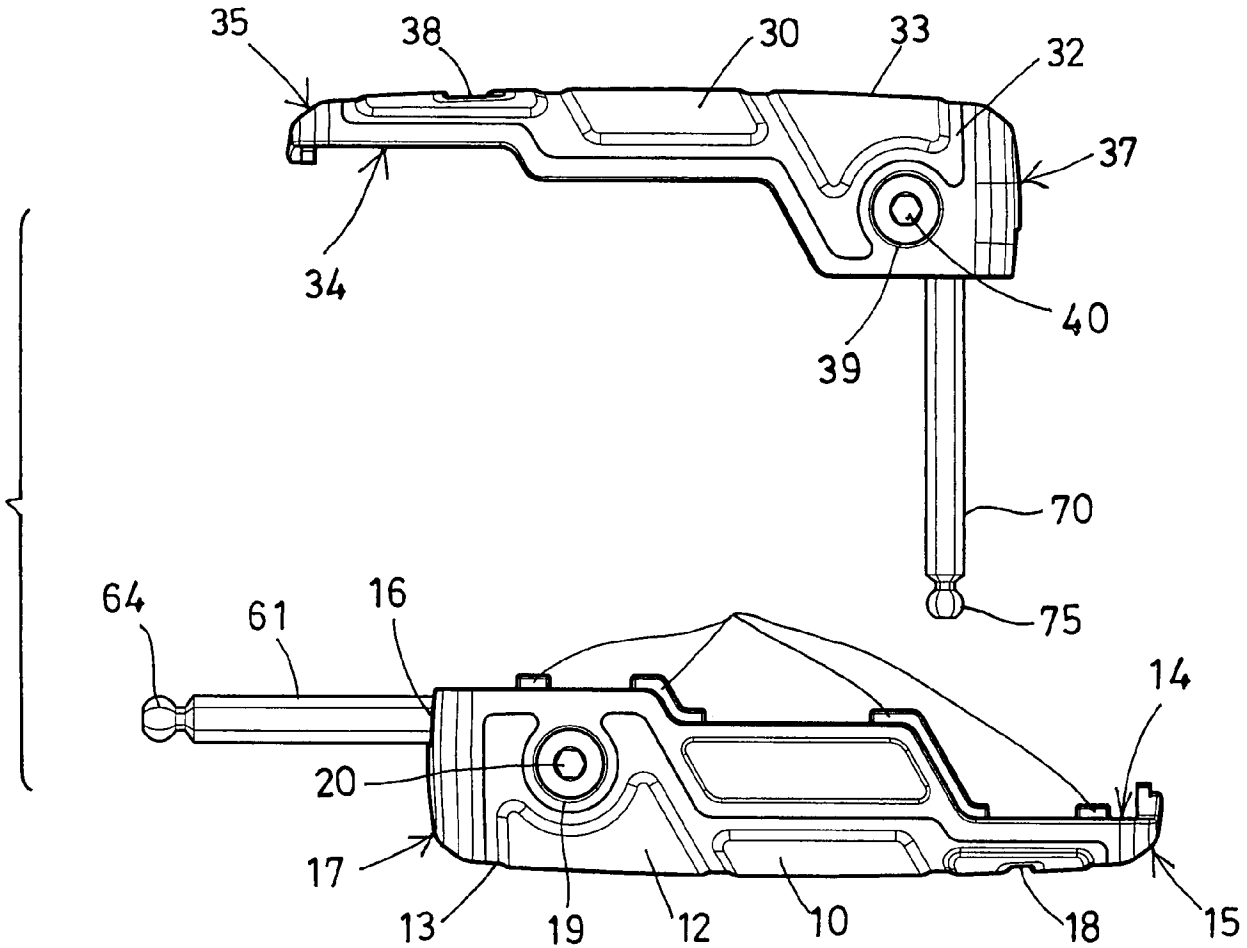
FIG. 3 is a plan and partial exploded view of the hand tool set combination.

Referring to the drawings, and initially to FIGS. 1-3, a hand tool set combination in accordance with the present invention comprises two or a pair of housings 10, 30 each including a chamber 11, 31 formed therein and formed or defined by a pair of side walls 12, 32 and a base wall 13, 33, and each including a cut-off portion or notch 14, 34 formed in one end portion 15, 35 thereof, and each including an opening 16, 36 formed in the other end portion 17, 37 thereof and communicative with the chamber 11, 31 thereof respectively, and each including an orifice 18, 38 formed in the base wall 13, 33 and located closer to the one end portion 15, 35 thereof and communicative with the notch 14, 34 thereof respectively, and each including an aperture 19, 39 formed in each of the side walls 12, 32 for attaching or mounting or securing or engaging with a pivot axle 20, 40 respectively which are attached or straddled between the side walls 12, 32 of the housings 10, 30 respectively.

A bracket or frame 50, 51 is disposed or engaged into the chamber 11, 31 of each of the housings 10, 30 and engaged with the side walls 12, 32 and the base wall 13, 33 respectively, and includes a compartment 52 formed therein and formed or defined by a pair of side panels 53 and a base panel 54, and includes a hole 55 formed in each of the side panels 53 and aligned with the aperture 19, 39 of the side walls 12, 32 of the housings 10, 30 respectively for receiving or engaging with the pivot axle 20, 40 respectively. It is preferable that the housings 10, 30 may be made of weaker materials, such as plastic or synthetic materials, or the like, and the frames 50, 51 are made of stronger materials, such as plastic materials, metal or steel or alloy materials, or the like, for reinforcing the housings 10, 30.

Two or more tool members 60, 61, 62 each include a loop or ring 63 formed or provided on one end thereof for pivotally or rotatably engaging with the pivot axle 20 and for allowing the tool members 60-62 to be pivoted or rotated relative to the housing 10, for example, either of the tool members 60-62 may be pivoted or rotated relative to the housing 10 to a position perpendicular to the housing 10 (FIGS. 4, 6, 8), or to a position parallel to the housing 10 and extended out of the housing 10 and extended out through the opening 16 of the housing 10 (FIG. 3), or to a position received or engaged or stored in the housing 10 (FIGS. 1, 2, 7), the tool members 60-62 each may include a tool device 64 formed or provided on the other end or the free end thereof for engaging with or for driving various tools or fasteners (not shown).

Figure 5:
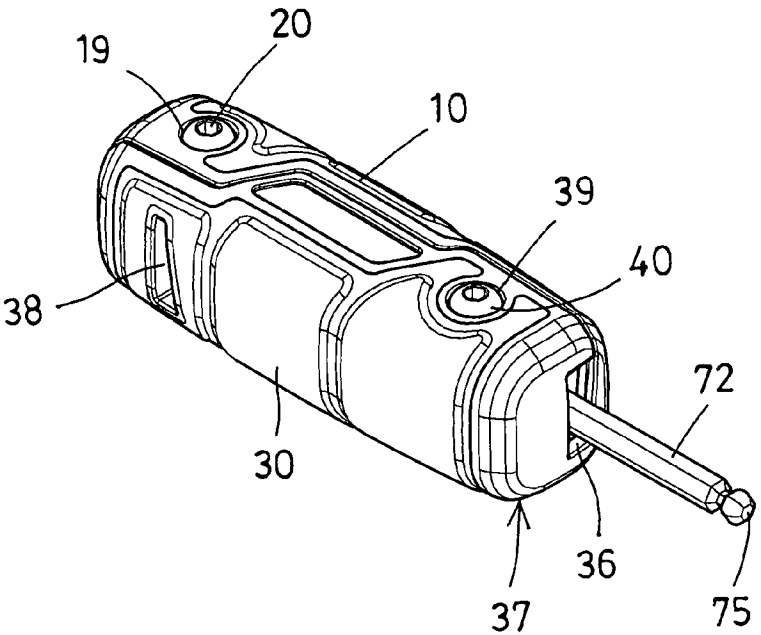
FIGS. 4 and 5 are perspective views illustrating the operation of the hand tool set combination.

Similarly, two or more tool elements 70, 71, 72, 73 each include a loop or ring 74 formed or provided on one end thereof for pivotally or rotatably engaging with the pivot axle 40 and for allowing the tool elements 70-73 to be pivoted or rotated relative to the housing 30, for example, either of the tool elements 70-73 may be pivoted or rotated relative to the housing 30 to a position perpendicular to the housing 30 (FIGS. 3, 8), or to a position parallel to the housing 30 and extended out of the housing 30 and extended out through the opening 36 of the housing 30 (FIGS. 5, 7), or to a position received or engaged or stored in the housing 30 (FIGS. 1, 2, 4, 6), the tool elements 70-73 each may include a tool device 75 formed or provided on the other end or the free end thereof for engaging with or for driving various tools or fasteners (not shown).

As shown in FIG. 1, the housing 30 includes one or more anchoring members or projections or cavities 41 formed therein, and the other housing 10 includes one or more anchoring members or cavities or projections 21 extended outwardly therefrom for engaging with the anchoring members or cavities 41 of the housing 30 and for anchoring or positioning or retaining the housings 10, 30 together and for preventing the housings 10, 30 from being moved or disengaged or separated from each other. The housings 10, 30 each include one or more magnetic members 22, 42 attached or mounted or secured thereto for engaging with each other and for further anchoring or positioning or retaining the housings 10, 30 together and for further preventing the housings 10, 30 from being moved or disengaged or separated from each other.

Figure 4:
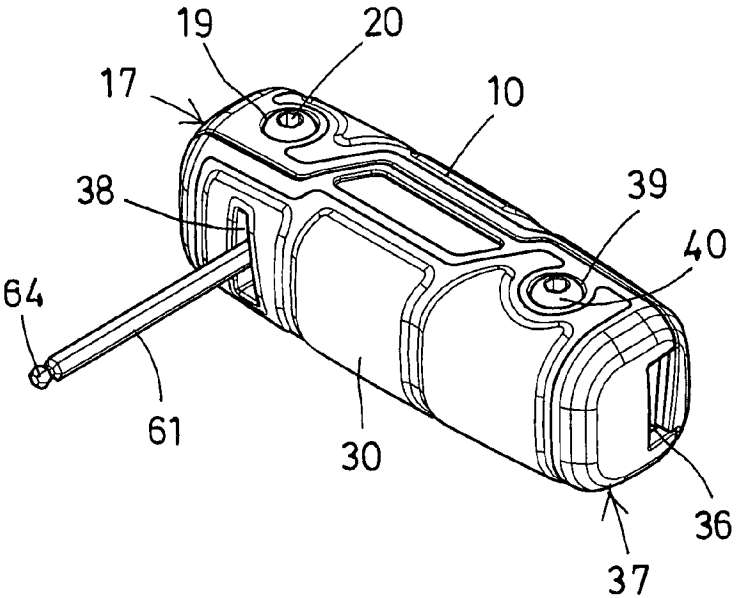
Figure 6:
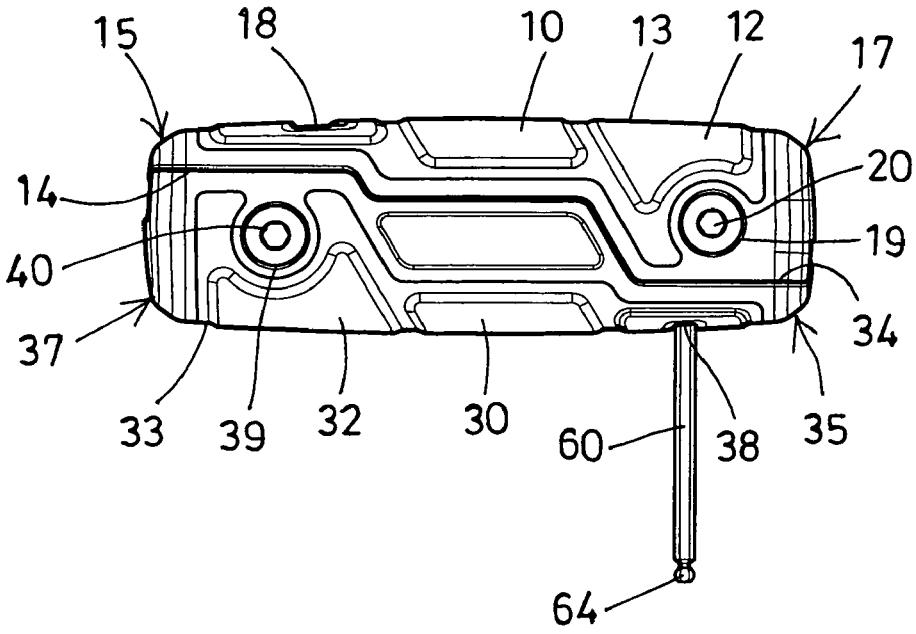
FIGS. 6 and 7 are plan schematic views of the hand tool set combination as shown in FIGS. 4 and 5 respectively.
Figure 7:
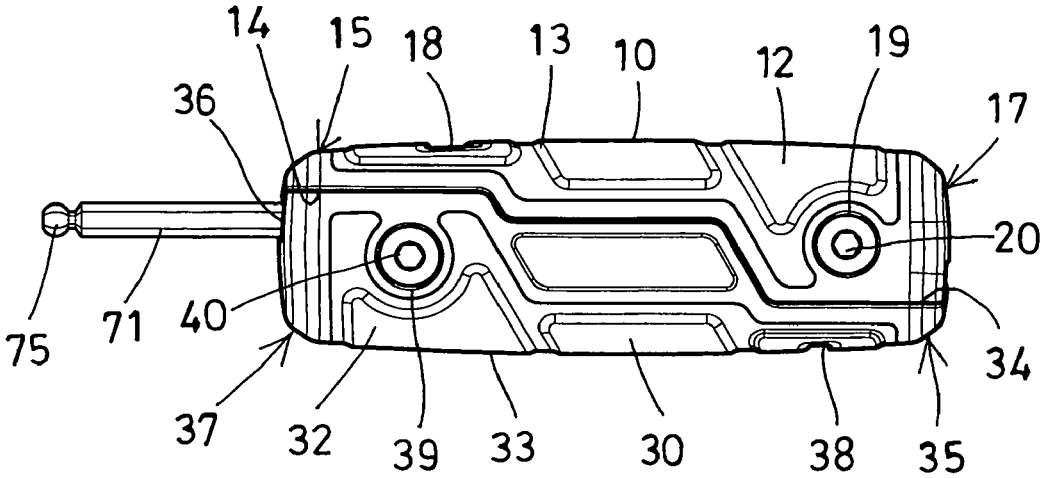
Figure 8:
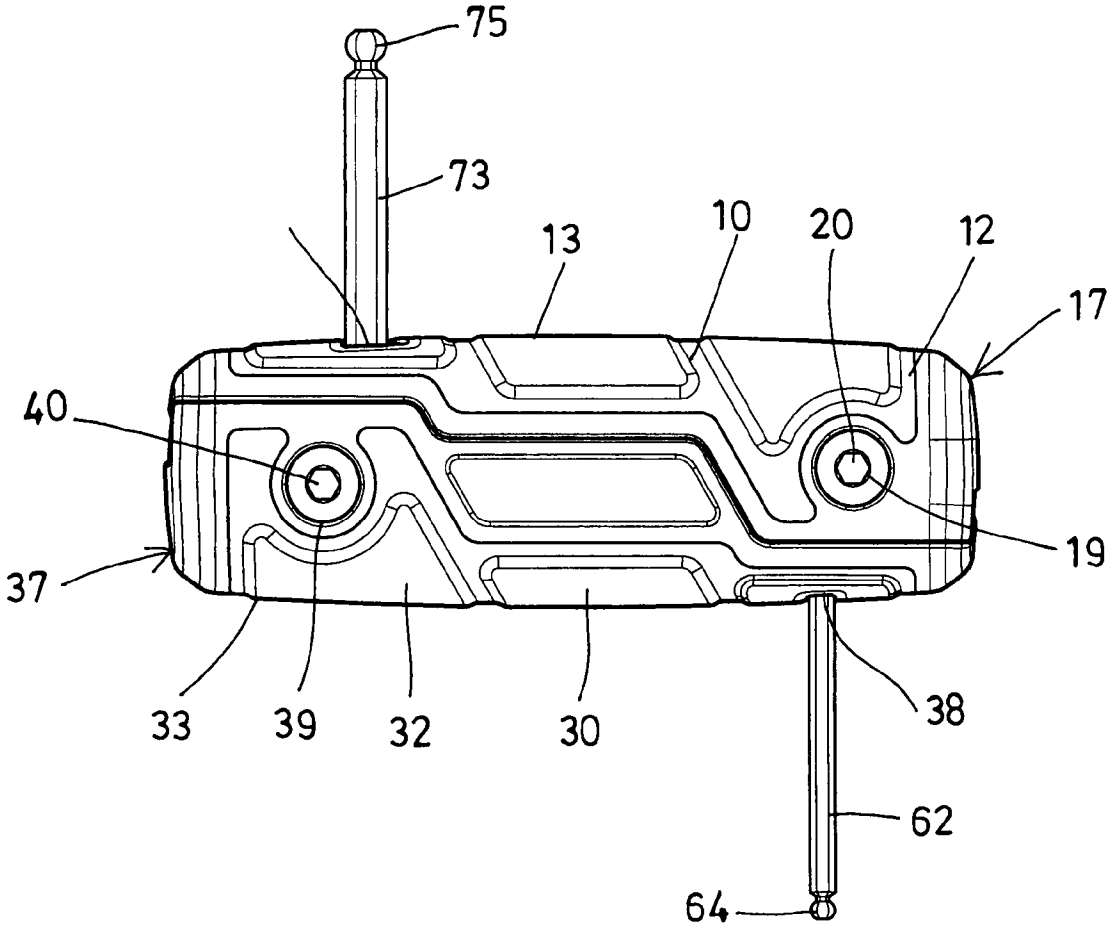
FIG. 8 is a plan schematic view similar to FIGS. 4 and 5, illustrating the operation of the hand tool set combination.

In operation, as shown in FIGS. 3-8, either of the tool members 60-62 or the tool elements 70-73 may be pivoted or rotated relative to the housing 10, 30 respectively and may be selectively used by the users. As shown in FIG. 3, the housings 10, 30 may be selectively used by the users, as shown in FIGS. 4, 6, 8, either of the tool members 60-62 or the tool elements 70-73 may be pivoted or rotated relative to the housing 10, 30 respectively and may be extended or engaged out through the orifice 18, 38 of the housings 10, 30 respectively for allowing the tool members 60-62 or the tool elements 70-73 to be effectively or solidly driven or rotated by the housings 10, 30 respectively, for allowing the hand tool set combination in accordance with the present invention to include many more tool members 60-62 or tool elements 70-73 that may be selectively used by the users.

Accordingly, the hand tool set combination in accordance with the present invention includes two casings engageble with each other and each casing having one or more pivotal or rotatable tool members for providing a variety of tool members of different sizes or dimensions or scales.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand tool set comprising:

a first housing including a chamber formed therein and defined by a pair of side walls and a base wall, and including an orifice formed in said base wall, and including a first anchoring member, a first pivot axle attached between said side walls of said first housing, at least two tool members pivotally engaged with said first pivot axle and rotatable relative to said first housing, a second housing including a chamber formed therein and defined by a pair of side walls and a base wall, and including an orifice formed in said base wall of said second housing, and including a second anchoring member for engaging with said first anchoring member and for anchoring said first and said second housings together, a second pivot axle attached between said side walls of said second housing, and at least two tool elements pivotally engaged with said second pivot axle and rotatable relative to said second housing, and said at least two tool elements of said second housing being extendible out through said orifice of said first housing when said at least two tool elements are perpendicular to said second housing, and said at least two tool members of said first housing being extendible out through said orifice of said second housing when said at least two tool members are perpendicular to said first housing.

2. The hand tool set as claimed in claim 1, wherein said at least two tool members each include a ring provided on one end thereof for pivotally engaging with said first pivot axle of said first housing.

3. The hand tool set as claimed in claim 1, wherein said at least two tool members each include a tool device provided on a free end thereof.

4. The hand tool set as claimed in claim 1, wherein said at least two tool elements each include a ring provided on one end thereof for pivotally engaging with said second pivot axle of said second housing.

5. The hand tool set as claimed in claim 1, wherein said at least two tool elements each include a tool device provided on a free end thereof.

6. The hand tool set as claimed in claim 1, wherein said first housing includes an opening formed therein and communicative with said chamber thereof for selectively engaging with said at least two tool members.

7. The hand tool set as claimed in claim 1, wherein said second housing includes an opening formed therein and communicative with said chamber thereof for selectively engaging with said at least two tool elements.

8. The hand tool set as claimed in claim 1, wherein said first and said second housings each include at least one magnetic member for engaging with each other and for anchoring said first and said second housings together.

9. The hand tool set as claimed in claim 1, wherein said first and said second housings each include a frame engaged into said chamber thereof and having a compartment formed therein and defined by a pair of side panels and a base panel.

* * * * *